US008287201B2

(12) United States Patent
Salciarini et al.

(10) Patent No.: US 8,287,201 B2
(45) Date of Patent: Oct. 16, 2012

(54) TELESCOPIC CONTAINER FOR A PASTY OR LIQUID COSMETIC PRODUCT

(75) Inventors: Christian Salciarini, Couilly Pont aux Dames (FR); Benoit Donier, Tarcenay (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 0 days.

(21) Appl. No.: 13/124,100

(22) PCT Filed: Oct. 9, 2009

(86) PCT No.: PCT/FR2009/051931

§ 371 (c)(1),
(2), (4) Date: May 27, 2011

(87) PCT Pub. No.: WO2010/043803

PCT Pub. Date: Apr. 22, 2010

(65) Prior Publication Data

US 2011/0222954 A1 Sep. 15, 2011

(30) Foreign Application Priority Data

Oct. 13, 2008 (FR) ..... 08 05651

(51) Int. Cl.
*B43K 24/02* (2006.01)
*A46B 11/00* (2006.01)

(52) U.S. Cl. ..... 401/126; 401/109; 401/122

(58) Field of Classification Search ..... 401/109–114, 401/116, 120, 122, 126, 127, 129, 151
See application file for complete search history.

(56) References Cited

U.S. PATENT DOCUMENTS 5,636,931 A * 6/1997 Gueret ..... 401/126
(Continued)

FOREIGN PATENT DOCUMENTS

DE 3426351 A1 1/1986
(Continued)

OTHER PUBLICATIONS

International Search Report; International Application No. PCT/FR2009/051931; dated Feb. 10, 2010.

(Continued)

*Primary Examiner* — Tuan N Nguyen
(74) *Attorney, Agent, or Firm* — Hunton & Williams, LLP

(57) ABSTRACT

The invention relates to a vial for a liquid or pasty cosmetic product, comprising: an elongate body (10), extending in a longitudinal direction, a vessel containing said product and which is translatably movable inside the body, an application element (30) comprising a rod (31) rigidly connected to a cap (40) and ending in an applicator (32) suitable for being loaded with the product when dunked into the vessel, said cap being insertable into/onto the body by pushing said application element into the vessel up to a rest configuration and extractable from said body so as to extract the rod and the applicator from the vessel and from the body, and complementary sealing means (35 and 80) designed for translatably coupling the rod and the vessel in a relative sealing configuration, characterized in that the top position of the vessel in the body is defined by complementary retaining elements designed so as to generate a resistance against the downward movement of the vessel in the body from said top position, the configuration of the cap being such that, when coupled to the vessel while the latter is in the bottom rest position, said cap offers a large enough surface to enable a user to apply the force required for extraction from the body.

14 Claims, 13 Drawing Sheets

U.S. PATENT DOCUMENTS

| | | | | |
|---|---|---|---|---|
| 5,803,638 | A * | 9/1998 | Gueret | 401/122 |
| 7,841,794 | B2 | 11/2010 | Legastelois et al. | |
| 2004/0119297 | A1 | 6/2004 | Bella et al. | |
| 2006/0285911 | A1 | 12/2006 | Demellier | |

FOREIGN PATENT DOCUMENTS

| | | | |
|---|---|---|---|
| EP | 1721543 | | 11/2006 |
| FR | 2865910 | | 8/1985 |
| FR | 2870092 | A | 11/2005 |
| GB | 834486 | | 5/1960 |

OTHER PUBLICATIONS

International Search Report; International Application No. PCT/FR2006/001030, dated Sep. 13, 2006; 3 pages.

International Search Report; International Application No. PCT/FR2009/051929; dated Oct. 9, 2009.

European Search Report; Application No. EP1721543A1, dated Aug. 31, 2006.

* cited by examiner

Fig. 17
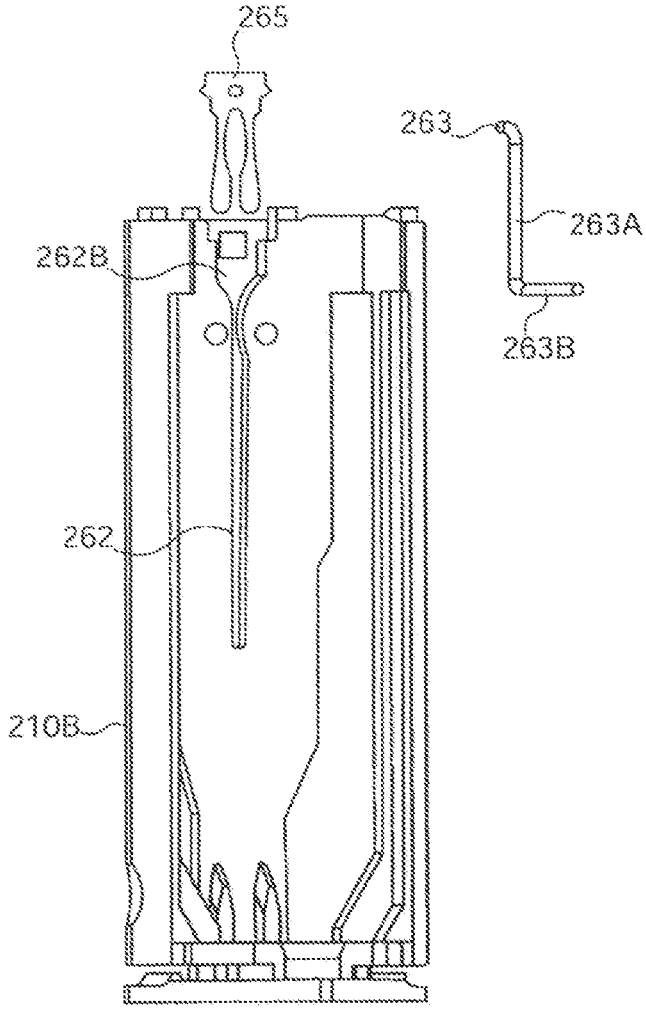
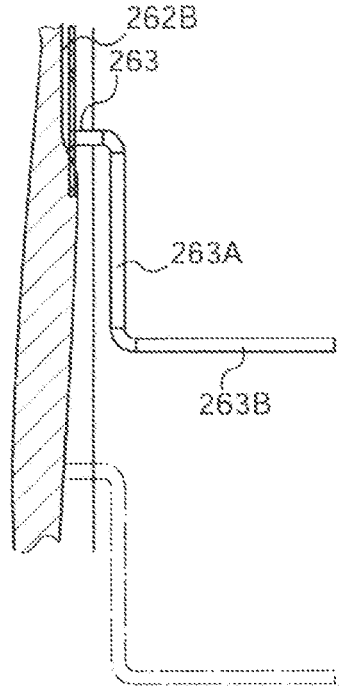
Fig. 18

Fig. 19
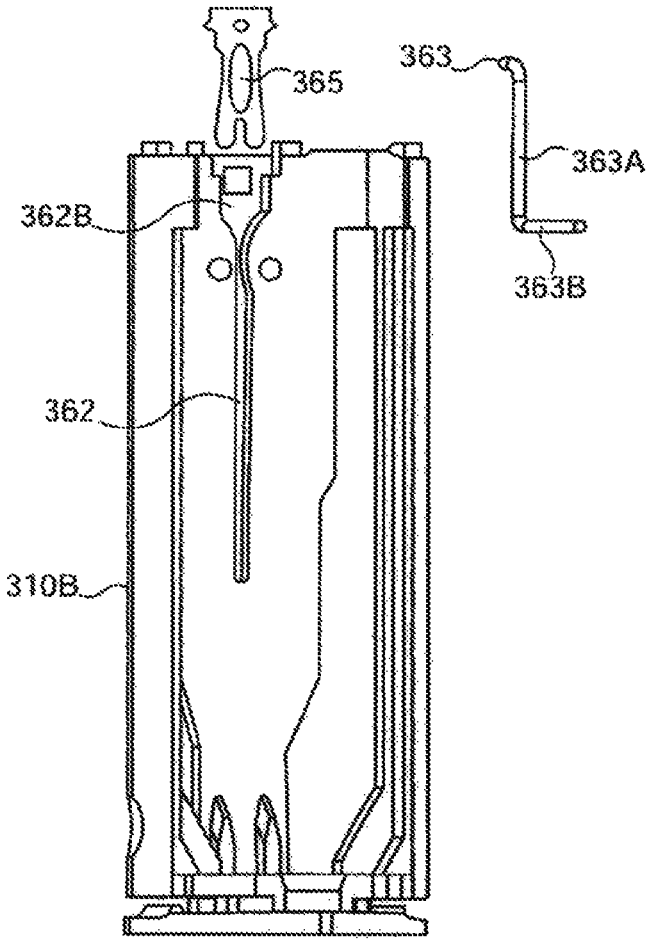
Fig. 20
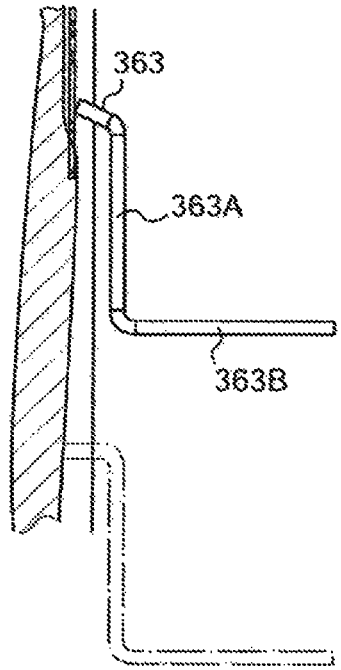
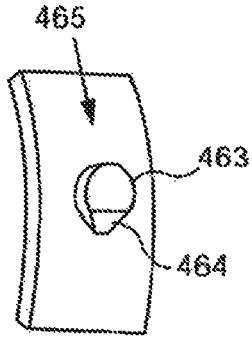
Fig. 21

TELESCOPIC CONTAINER FOR A PASTY OR LIQUID COSMETIC PRODUCT

CROSS-REFERENCE TO RELATED APPLICATIONS

This application is the U.S. National Phase of International Application No. PCT/FR2009/051931 filed on Oct. 9, 2009, which claims priority to French Application No. FR 0805651 filed Oct. 13. 2008, both of which are incorporated by reference herein in their entireties.

FIELD OF THE INVENTION

The invention concerns a container for a pasty or liquid cosmetic product of extendable configuration comprising an application member provided with an applicator which, outside periods of use for the application of the product, is partly engaged telescopically in a tubular reservoir containing the product to apply; it applies particularly, but not exclusively, to mascara containers, and even gloss containers.

BACKGROUND

Such containers, in particular mascara containers, conventionally comprise a wiper provided close to the neck of the container (in practice on the reservoir), which is adapted to keep back the excess product taken by the applicator each time it is plunged into the reservoir, into the mass of product.

In practice the application member comprises a cap which the user acts upon to manipulate the mascara applicator. The fact that the mascara is liquid or pasty means that efficient sealing must be provided outside periods when mascara is applied, when the cap is engaged on the neck of the container; in practice this sealing is obtained by a closure by screwing or by clip action of the cap onto the neck of the container. It follows that the cap is a member which forms a substantial part of the outside surface of a mascara container in closed configuration, and that combined movements or significant forces may have to be provided to open the container before an action to apply mascara.

Document EP-1 721 543 describes various containers for cosmetic product, including a container of mascara (or even of gloss in relation with FIGS. 18 to 24) comprising:

- a body which is elongate in a longitudinal direction and provided with a bottom and a free edge,
- a reservoir contained in that body and movable in translation between a low stable position and a high stable position, the reservoir comprising a neck,
- an elastically compressible device with two stable retraction positions which is disposed between the body and the reservoir and of which the two stable axial retraction positions define the two stable positions, low and high, of the reservoir,
- an application member comprising a shaft terminated by an applicator adapted to be loaded with mascara, this application member having a resting configuration in which a part of the shaft and the applicator are contained in the reservoir so as to enable the applicator to be loaded with mascara, and being able to leave that resting configuration until it is completely out of the reservoir and of the container,
- a cap joined to the shaft of the application member and adapted to engage within the body, the stable axial retraction configurations of the elastically compressible device being such that when the application member is in its resting configuration in the reservoir, the cap is either retracted into the body flush with the free edge of the body, or it projects at least partially from the body,
- a wiper provided at the exit of the reservoir so as to be passed through by the applicator when it enters the reservoir or when it is extracted out of it, and
- complementary sealing members respectively carried by the shaft and the neck of the reservoir constituted by a protuberance carried by the shaft and anchoring claws provided on the neck of the reservoir (in the high position of the reservoir, the claws spread outside the inside volume of the body in which the reservoir slides, whereas in low position, the claws are maintained in a brought-together configuration by the inside wall of that body so as to remain engaged on the protuberance).

Such a configuration is simple and reliable in use without significant risk of inadvertent opening, while making it possible to have very sleek aesthetics, and without leading to prohibitive voluminosity.

More particularly, the retraction of the cap into the body of the container enables the aesthetics of the container to be essentially defined by that body, while the presence of the elastically compressible device with two stable retraction positions enables a mere movement of pushing in of the cap, transmitted to the reservoir, to give rise to the passage of that device from one retraction position to the other, and leads either to the retraction of the cap (there then is very little risk of the cap inadvertently getting out of the body), or to a part of that cap coming to project sufficiently to enable that projecting part to be grasped between the fingers of a user then its extraction out from the body to perform the application of the product taken by the applicator (which only requires the user to make movements that are simple, with a single hand).

It should be noted that, in such a container, the reservoir is movable between two main positions which are essentially defined by the elastically compressible device:

- a low position in the body (enabling the cap to be flush with the free edge of the body), when the application member is in its resting configuration, that is to say that the elastically compressible device is in the most retracted of its stable configurations, and
- a high position in which its neck is substantially at the level of that free edge (to enable the separation of the complementary sealing members), defined by the most elongate of the stable configurations of the elastically compressible device.

The sealing members remain in cooperation while the reservoir is situated between these extreme positions, even when the cap has started to come out from the body.

Thus, not only is the use of such a container simple and reliable, but such a container furthermore has good sealing characteristics, without however requiring complex movements by the user, but at the cost of a certain complexity of structure.

It is to be noted that, independently of the aesthetic effect which enables the retraction of the application member into the body, an advantage of the fact that this application member can engage telescopically in the body is to enable good ergonomics to be obtained by the choice of axial dimensions of the cap of the application member and of the body (the greater these dimensions, the easier it is for a user to manipulate that cap and that body) without those axial dimensions determining the bulk of the container, in resting configuration (the greater the telescopic engagement of the application member in the body, the smaller the axial bulk).

SUMMARY OF THE INVENTION

The invention relates to a container for a pasty or liquid cosmetic product comprising a body, an application member engaged telescopically in that body and a reservoir adapted to contain that product and to receive a part of the application member when it is in a resting configuration, having sealing properties at least similar to those of the aforementioned container, the use of which is simple and reliable without requiring complex movement by the user, while having a simpler structure not requiring the presence of an elastically compressible device.

To that end, the invention provides a container for a pasty or liquid cosmetic product, comprising:

an elongate body, extending in a longitudinal direction, provided with a bottom zone and a free edge, a reservoir containing that product and which is movable in translation in the body between a low resting position close to the bottom zone and a high working position close to the free edge, that reservoir comprising a neck, an application member comprising a shaft joined to a cap and terminated by an applicator adapted to become loaded with product when it is plunged into the reservoir in a reloading configuration relative to that reservoir in which the shaft passes through the neck of the reservoir, the cap being adapted to engage in/on the body by pushing the application member into the reservoir to attain the resting configuration and adapted to be extracted from the body so as to extract the shaft and the applicator out from the reservoir and from the body, and complementary sealing means, respectively provided on the shaft of the application member and on the reservoir in the vicinity of its neck, designed so as to link the shaft and the reservoir in translation in a relative sealing configuration, from the low position until near the high position of the reservoir in the body and vice-versa, characterized in that the high position of the reservoir in the body is defined by complementary retaining members provided between the body and that reservoir and which are designed so as to generate a resistance to the descent of the reservoir into the body from that high position, the configuration of the cap being such that, when it is linked to the reservoir while the reservoir is in the low resting position, it provides a sufficient grip to enable a user to apply a force of extraction out from the body.

The complementary retaining members are advantageously provided on the inside wall of the body and on the outside wall of the reservoir, respectively.

It will be understood that a container in accordance with the invention has most of the advantages of a container such as the one described in document EP-1 721 543 without requiring the presence of any compressible device, while taking advantage of the fact that the presence of complementary sealing members between the application member and the reservoir in practice provides axial linkage which ensures that, provided that the cap of that application member gives a sufficient grip to a user, in the resting configuration of the container, to apply to it a traction outwardly of the body, that extraction implies simultaneous rising of the reservoir from its low position in the body until it reaches its high working position. The complementary members for retaining the reservoir in the high position in the body then enable the holding of that reservoir in its working position after the user has dissociated the complementary sealing members, it suffices to dimension them while taking into account the mechanical constraints to which that reservoir is liable to be subjected in the high working configuration (in particular the passing by the applicator of the wiper which that reservoir comprises, in the case of mascara, and gravity).

Advantageously, the complementary retaining members are designed so as not to hinder the coming into the high position of the reservoir at the end of its rise from the low position, which gives those complementary retaining members a selective effect depending on the direction if movement of the reservoir; they tend to resist the descent of the reservoir, but do not give rise to resistance when the user brings the reservoir into that high position, and do not require needless effort by the user on bringing the container into its operating configuration.

Of course, the complementary retaining members may, in a simplified configuration, be simply constituted by a combination of a continuous or discontinuous circumferential rib, formed on the body or the reservoir, and of a continuous or discontinuous circumferential groove, formed on the other of those parts so as to obtain a clipping effect.

However, advantageously, the complementary retaining members comprise a hollow guide track substantially disposed in the longitudinal direction of the body, and a follower finger adapted to pass in that hollow guide track during the movements of the reservoir between its low and high positions in the body, an elastic member being added on in the vicinity of that hollow track to elastically resist the passage of the follower finger at the start of a movement of the reservoir from its high working position to its low resting position. The desirability of such a combination of a guide track and a follower finger is in particular to provide good control of the trajectory of the reservoir within the body; as to the presence of an elastic member, the advantage of this is to provide elastic retaining, without risk of degradation, while the fact that this part is mounted on enables the resistance provided by those complementary retaining members to be regulated according to the various forces against which that retaining must be ensured (in particular as regards the forces applied to the reservoir each time the wiper is passed in the case of a mascara container).

Preferably, this elastic member is designed and disposed so as to deform parallel to the walls of the reservoir and of the body but transversely to the longitudinal direction of the body. Such a disposition makes it possible, in particular, for that elastic member to deform with a magnitude which is independent of the width of the gap between those walls of the reservoir and of the body.

According to an advantageous example embodiment, the mounted-on elastic member is disposed along a flank of that hollow guide track at its end defining with the follower finger the high working position of the reservoir, such that this strip encroaches on the path of the follower finger and can only be passed by that follower finger by elastic bending. Such a configuration is particularly simple.

Preferably, this end of the guide track defining with the follower finger the high working position of the reservoir is a portion having the shape of a drop the bottom of which is provided with non-return steps imposing single-direction passage of the follower finger in that drop, the mounted-on elastic member being situated in the vicinity of a zone of that portion in which the follower finger passes at the start of a movement of the reservoir from its high working position to its low resting position. This enables the aforementioned selective effect of the complementary retaining members to be obtained.

According to another advantageous example embodiment, the hollow guide track comprises, in the bottom of its end defining with the follower finger the high working position of the reservoir, a cavity comprising a ramp parallel to the longitudinal direction and connecting to the bottom of the rest of the track, the follower finger is elastically urged towards the bottom of that track and the mounted-on elastic member is a U-shaped part engaged in the cavity such that its branches are longitudinally oriented, those branches being configured so as to form a space between them able to receive the follower finger while defining, at the opposite end to the bottom of the U relative to that space, a stricture which can only be passed by the follower finger, from that space outwardly of the U-shaped part, by a movement apart of those branches forced by that follower finger, those branches being furthermore configured and disposed such that, when the reservoir approaches its high working position, the follower finger slides on the bottom of the track then over the branches until it latches into the space. An advantage of such a configuration is to obtain the selective effect mentioned above with regard to the complementary retaining members, by the simple combination of a cavity and of a U-shaped part, in a hollow track which may quite-simply be straight.

According to still another advantageous example embodiment, the hollow guide track comprises a cavity in the bottom of its end defining with the follower finger the high working position of the reservoir, the follower finger is elastically urged towards the bottom of that track and the mounted-on elastic member is a mounted-on part engaged in the cavity so as to enable sliding of the follower finger over that part until latching of the follower finger in that hollow is attained when the reservoir approaches its high working position, that follower finger being elastically urged towards the bottom of that cavity so as to be able to escape out from that cavity by a ramp effect. In other words, the escape of the follower finger out from the space in which it latches in the high position of the reservoir is obtained by an appropriate configuration of the follower finger or support.

Thus, according to a first advantageous example, the follower finger is carried by an elastically flexible strip and comprises a flank forming a ramp enabling that follower finger to come out of that hollow. According to another advantageous example, the follower finger is connected to a support by a flexible connection zone, by virtue of which that follower finger may incline longitudinally to escape out of the hollow of the mounted-on part.

The configuration of the hollow track at its end which, with the follower finger, conjointly defines the low resting position of the reservoir may be a simple cul-de-sac.

However, it may be desirable to configure that track and its follower finger so as to ensure the user is provided with a sensation indicating that the low resting position has indeed been attained, for example by a latching effect. To that end, the hollow track advantageously comprises, at its end defining with the follower finger the low position of the reservoir, a cul-de-sac portion comprising a stricture generating resistance to the passage of the follower finger.

It may also be desired to ensure that the reservoir is lowered in the body until its low position is reached. To that end, the hollow track advantageously comprises, at its end defining with the follower finger the low position of the reservoir, a drop-shaped portion provided with non-return steps defining a single direction of passage of the follower finger in that portion. Consequently, as soon as the reservoir has descended to reach a position in which the follower finger has passed a single one of the non-return steps (in practice formed in the bottom of the track), the reservoir will not be able to rise again until it has first attained its low position. Furthermore, this configuration also enables an effect to be obtained indicating to the user if she has indeed freed the reservoir out from its low resting position; to that end, an elastic member is advantageously disposed in the vicinity of that drop-shaped portion so as to generate a resistance against the passage of the follower finger in the direction of a rise of the reservoir in the body.

Various linkages may be envisaged between the application member and the reservoir.

According to an advantageous configuration, these complementary sealing members comprise, on the shaft, a protuberance comprising, towards the applicator, a sealing portion and, towards the cap, a transverse contact surface, and comprise, on the reservoir, before reaching its neck, a constriction adapted to receive the sealing portion in axial abutment and, beyond its neck, a collar formed, along its circumference, by a plurality of alternating rigid sectors and elastic sectors, that collar having a relaxed configuration in which it is of larger size than the inside cross-section of the body and a restricted configuration in which it is confined inside that body, the rigid sectors comprising, along the inside edge of that collar, rims adapted to come into axial abutment against the transverse contact surface of the protuberance so as to maintain the sealing portion against the constriction when the application member is in its resting configuration, Such a construction has similarities with the configuration provided by the document EP-1 721 543 (which may also be used in the context of the present invention) which comprises claws which progressively come to apply an axial force on the protuberance as they come together.

However, it may be understood that that the existence of those claws, which participate in the definition of the opening which the shaft and its applicator must pass through on entering the reservoir or on extraction therefrom, allows slots to remain which are liable to be clogged by the product carried by the applicator, which may adversely affect the cleanliness of the neck of that reservoir, as well as the durability of the applicator (if there is a risk of the latter being degraded when getting past those claws). Furthermore, the axial force which is applied to the shaft on account of the ball shape of the protuberance may vary over time or with the wear of those claws such that the sealing effect is also liable to vary over time. On the other hand, by virtue of the fact that the sealing is provided by virtue of the implementation, not of claws, but of a collar formed by a plurality of rigid sectors and elastic sectors, the formation is avoided of interstices into which the product may enter with the risk of hindering subsequent utilizations of the container. Moreover, due to the fact that this collar acts on a transverse contact surface comprised by the protuberance, the retraction of that that collar does not necessarily involve an axial force, which enables the sealing to be provided independently of the configuration of the collar at any particular instant, provided that it has started to retract from its relaxed configuration.

Advantageously, the sealing part of the protuberance comprises an elastic portion or a seal, for example mounted on.

According to another advantageous configuration, which is simpler and thus more economical and more robust, the complementary sealing means comprise, on the shaft, a protuberance comprising, towards the applicator, a sealing portion and, towards the cap, a transverse contact surface, and comprise, on the reservoir, a seat-forming constriction adapted to receive, in axial abutment, the sealing portion and at least one boss which is formed on the inside wall of the reservoir between its neck and that constriction and adapted to be passed by the protuberance when the application member is engaged in reloading configuration in the reservoir, and to maintain that protuberance against its seat for as long as the application member remains in reloading configuration.

BRIEF DESCRIPTION OF THE FIGURES

Objects, features and advantages of the invention will appear from the following description, given by way of illustrative non-limiting example with reference to the accompanying drawings in which:

FIG. 17 is a partially exploded view in elevation of a variant embodiment of the complementary retaining members, FIG. 18 is a partial view in cross-section, FIG. 19 is a partially exploded elevation view, similar to that of FIG. 17, of still another variant embodiment of the complementary retaining members, FIG. 20 is a partial view in cross-section, similar to that of FIG. 18, and FIG. 21 is a perspective view of a variant embodiment of the follower finger of FIG. 8.

DETAILED DESCRIPTION OF PREFERRED EMBODIMENTS

Figure 1:
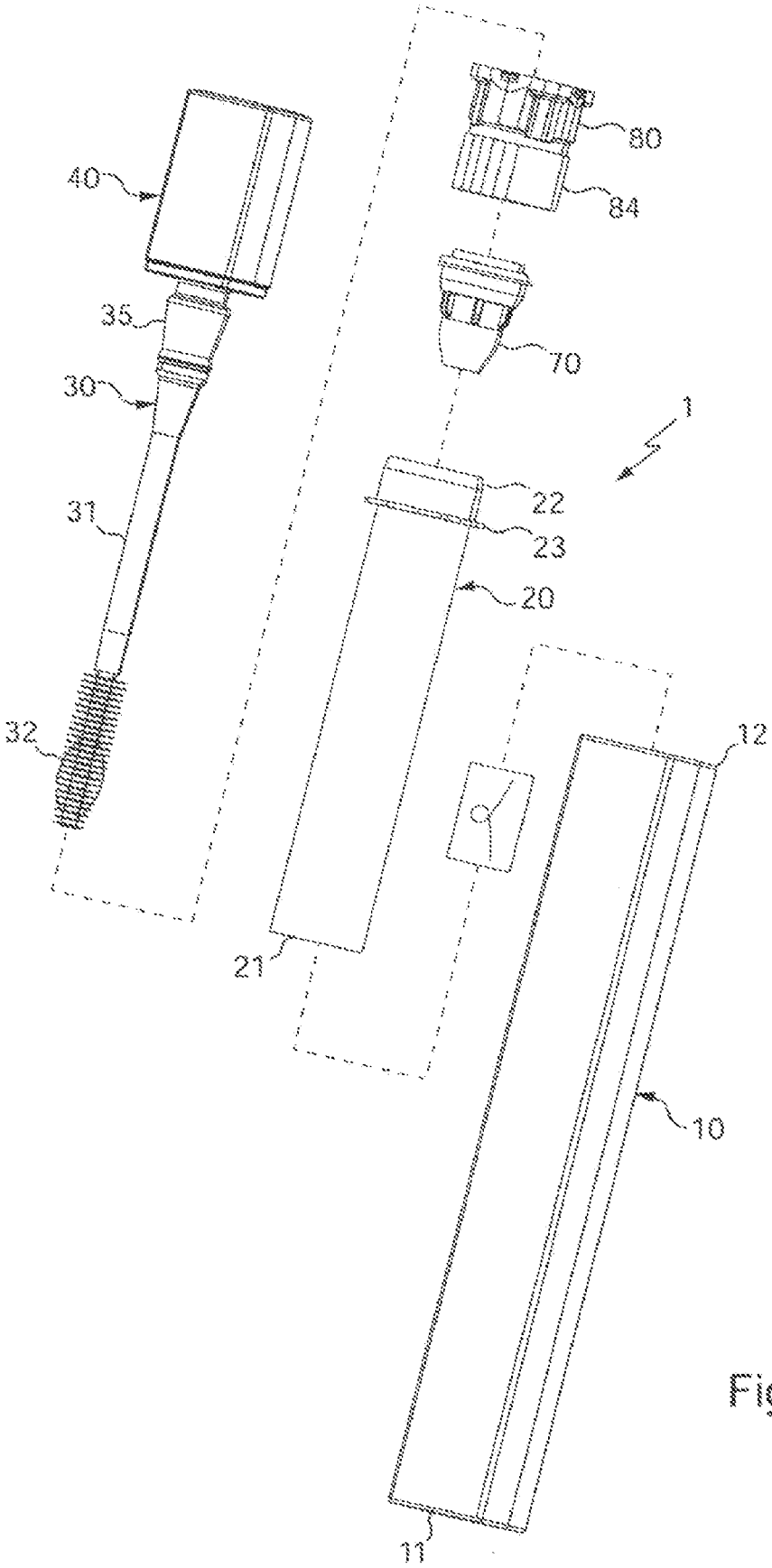
FIG. 1 is a diagrammatic view of a mascara container in accordance with invention.

The container of FIG. 1, represented by the general reference 1, mainly comprises:

an elongate body 10 extending in a longitudinal direction, which is vertical here, and provided with a bottom zone 11 and a free edge 12, a reservoir 20 containing mascara comprising a bottom 21 and a neck 22, and which is adapted to be entirely contained in the body while being movable in translation therein between a low resting position (close to the bottom zone of the body) and a high working position (closer to the free edge); that reservoir here comprising a collar 23 facilitating the guiding and holding of the reservoir in the body, an application member 30 comprising a shaft 31 joined to a cap 40 and terminated by an applicator 32 adapted to become loaded with product when it is plunged into the reservoir in a reloading configuration relative to that reservoir in which the shaft passes through the neck 22 of the reservoir, the cap 40 being adapted to engage in, or on, the body by pushing the application member into the reservoir to attain the resting configuration and adapted to be extracted from the body so as to extract the shaft and the applicator out from the reservoir and from the body, and complementary sealing means 35 and 80, respectively provided on the shaft of the application member and on the reservoir in the vicinity of its neck, designed so as to link the shaft and the reservoir in translation in a relative sealing configuration, from the low position until near the high position of the reservoir in the body and vice-versa.

In the example of FIG. 1, two parts are adapted to be mounted at the neck of the reservoir 20:

a wiper-forming part 70, adapted to engage in the top part of the reservoir across its neck, and a sealing part 80, adapted to engage on the end of the reservoir so as to cap the wiper forming part, and adapted to cooperate with a protuberance 35 carried by the shaft of the application member.

These parts are differentiated here, which makes it possible to clearly identify the functions provided at the neck of the reservoir, but it should be understood that these functions may, as a variant, be provided by just a single part. These parts are in practice joined to the reservoir and thus form an integral part thereof.

As will be detailed below, the cooperation of the sealing part 80, joined to the reservoir, and of the protuberance 35 of the shaft establishes a link between the reservoir and the application member.

The body may be formed by one or more parts joined to each other; in the example considered here the body comprises a tube of some particular cross-section (circular, rectangular, polygonal or other), open at both ends; there may be a mounted-on cage-forming part, not represented in FIG. 1, which is advantageously provided to constitute the bottom of the body; such a body, when it exists, may as a variant be formed as a single part with the tubular part, for example by molding.

The high position of the reservoir in the body is defined by complementary retaining members, provided on the inside wall of the body and on the outside wall of the reservoir, which are designed so as to generate a resistance to the descent of the reservoir into the body from that high position, preferably without hindering the coming into the high position at the end of rising from the low position.

Furthermore, the configuration of the cap is such that, when it is linked to the reservoir while the latter is in the low resting position, it provides sufficient grip to enable a user to apply a force of extraction out from the body; in practice such a sufficient grip is obtained provided that the cap projects out from the body by a few millimeters, typically 5 millimeters, or even a little less (for example 3 millimeters); of course, that minimum distance of projection depends on the state of the surface of the projecting portion of the cap (the rougher that surface state, the smaller that distance can be).

Generally, complementary retaining members are diagrammatically represented by the common reference 60 in FIG. 1.

In the examples described below, these complementary retaining members comprise a hollow guide track substantially disposed in the longitudinal direction of the body, and a follower finger adapted to pass in that hollow guide track during the movements of the reservoir between its low and high positions in the body, an elastic member being added on in the vicinity of that hollow track to elastically resist the passage of the follower finger at the start of a movement of the reservoir from its high working position to its low resting position.

FIGS. 2 to 6 correspond to a first example embodiment of the container in accordance with the invention. The reference signs which relate to similar members to those of FIG. 1 are identical to those of that FIG. 1, while being allocated a single quote index.

Figure 2:
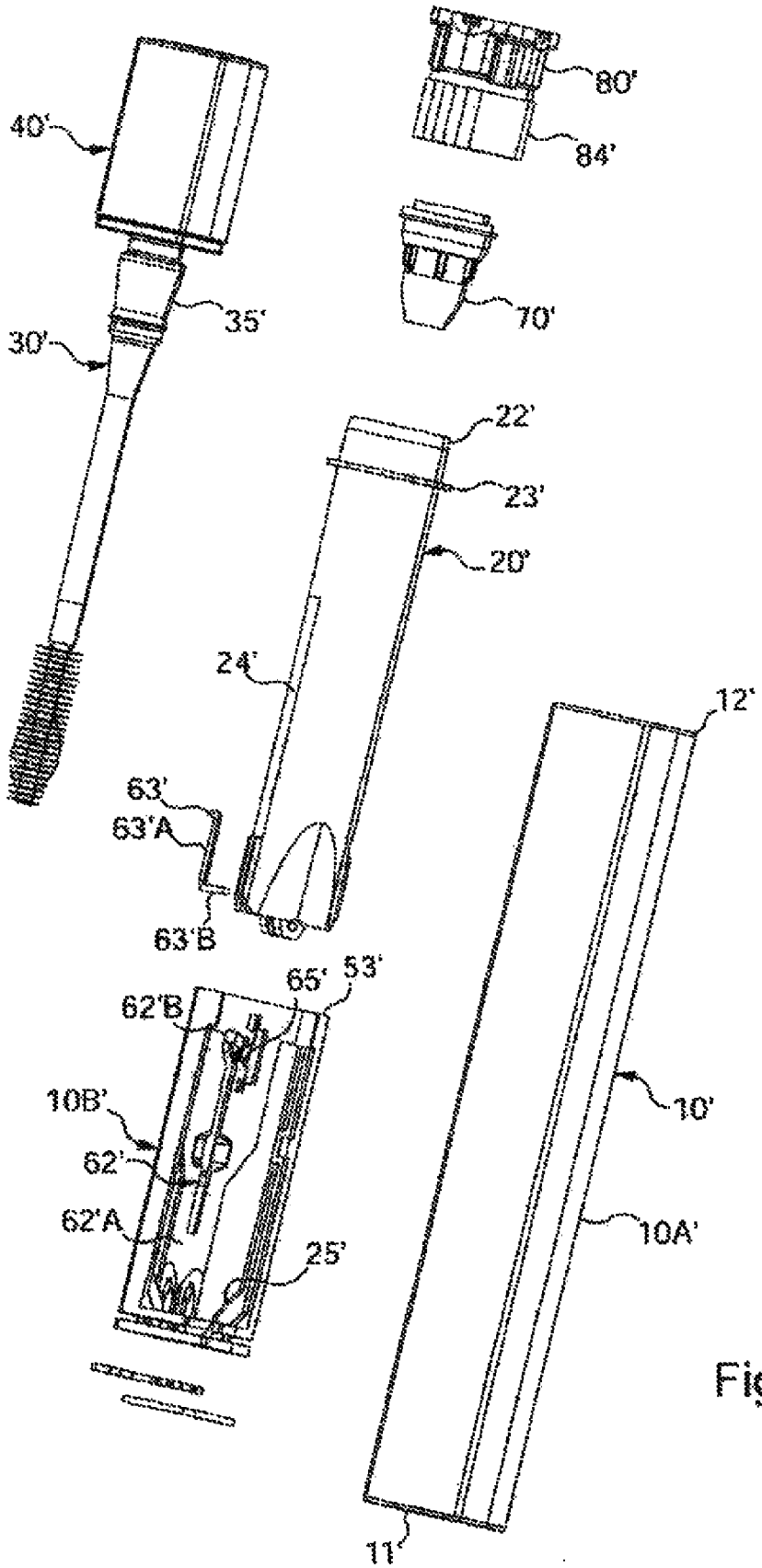
FIG. 2 is an exploded side view of such a container according to a first embodiment of the complementary retaining members.
Figure 3:
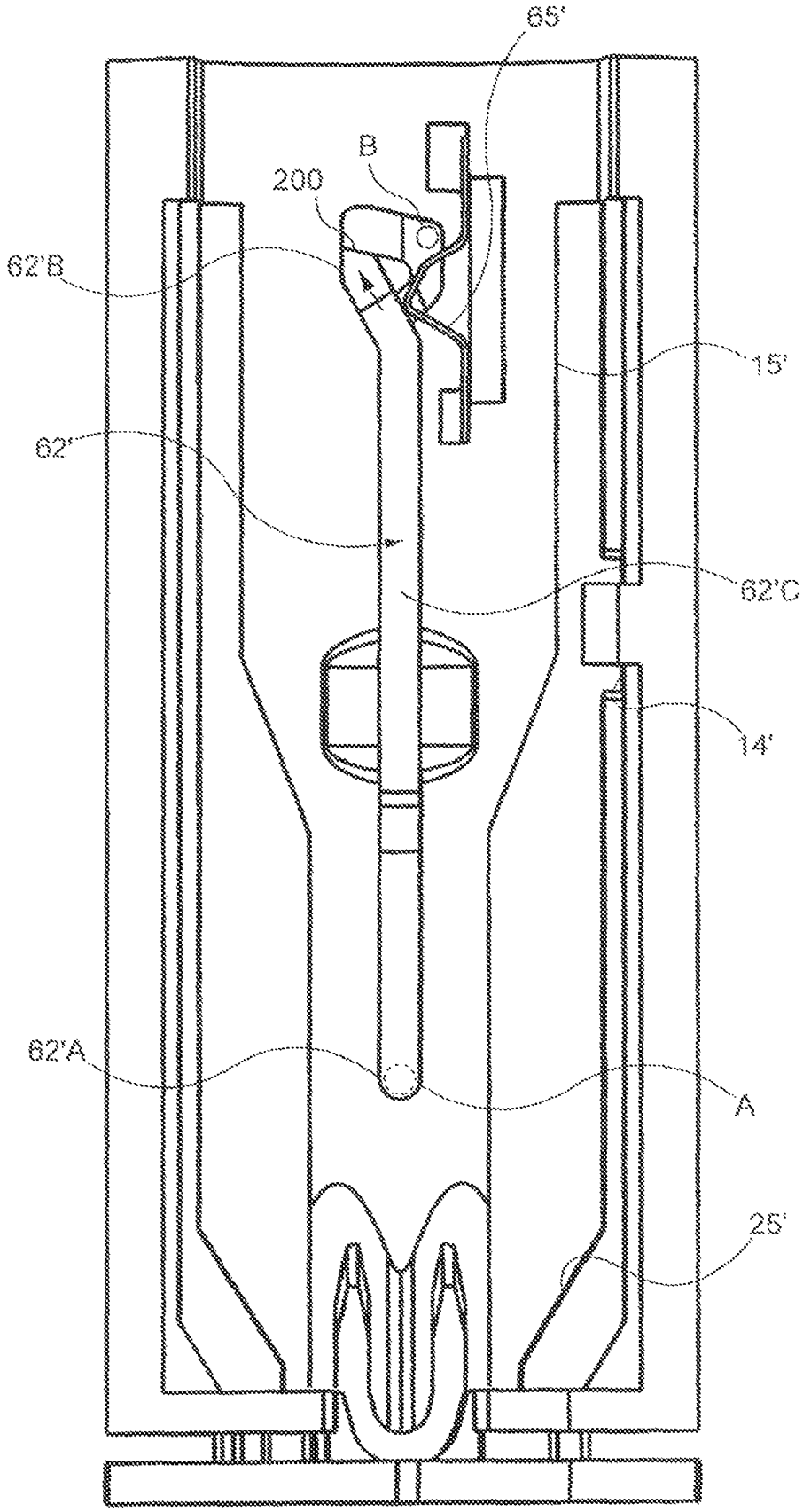
FIG. 3 is an elevation view of a part of those members.

The structure of the complementary retaining members are apparent from FIGS. 2 and 3.

The hollow guide track, denoted 62' is carried here by the body, more particularly by the mounted-on cage-forming part 10B' whereas the follower finger denoted 63' is carried by the reservoir. It can however be understood that the situations may be swapped, in a variant not represented.

The hollow guide track 62' comprises two end portions 62A' and 62B' one of which, in the described example, is formed so as to have the shape of a drop. Conjointly with the follower finger, this portion 62B' defines the high position of the reservoir.

The follower finger 63' is preferably mounted at the end of an arm 63'A, which is oriented generally parallel to the longitudinal direction of the container, and of which the other end 63'B is articulated to the portion which carries that follower finger.

In the example considered here in which the follower finger is carried by the reservoir, the end 63'B of the arm is bent so as to be able to be articulated under the bottom of that reservoir.

The details of the hollow guide track 62' clearly appear in FIG. 3.

It can be understood that, when the follower finger is the low portion 62'A, the reservoir is in its low resting position and is in principle not subject to any force; the reservoir thus remains in that position until a user requires access to the content of that reservoir.

The other end portion, 62'B, is advantageously provided with non-return steps 200 ensuring that the finger, at the end of extraction from the reservoir towards its high position, necessarily follows only one branch of the drop shape, here the left one, and necessarily attains its end position B before being able to descend again towards the portion 62'A.

It may be noted that the guide track comprises an common intermediate portion 62'C for the rising of the follower finger from the low position A towards the high position B and for the descent from B towards A; as a variant not shown, there are two separate longitudinal tracks, one for the ascent, one for the descent.

Complementary guide members are advantageously provided to ensure good control of the movement of the reservoir in the body; these members are diagrammatically represented here by a longitudinal groove 24', here formed on the outside wall of the reservoir, cooperating with a longitudinal rib 25', here formed in the cage 10B'.

As indicated above, complementary retaining members are provided to generate a resistance to the descent of the reservoir into the body from that high position, preferably without hindering the coming into the high position at the end of rising from the low position.

To that end, an elastic member 65' is provided in the vicinity of the high end portion of the track, along one flank thereof, so as to encroach on the path of the follower finger, when it tends to leave the corner-shaped zone B; consequently, passage of the finger is possible only on condition a sufficient pushing-in force is applied on the cap to force that elastic member to deform until it can be passed by the finger. It will be understood that, by virtue of the drop-shaped conformation of the portion 62'B, this elastic member constitutes an obstacle which the finger must pass at the time of its descent, but not at the time of its ascent.

It may be noted that this elastic member is a strip here, preferably of metal, which is mounted on, which makes it possible to regulate as best as possible, depending on the stresses which the reservoir is liable to have to be subjected in its high working position, the magnitude of the point of resistance constituted by that part, by an appropriate choice of the elastic member put into place (from the point of view of material or geometry, in particular); in practice, care should taken to ensure that, in the case of a mascara container, that point of resistance suffices to maintain the reservoir in place when a user plunges the applicator into the reservoir against the resistance generated by the wiper; of course, that point of resistance is also formed so as to be able to simply bear the weight of the reservoir.

It may be noted that such an elastic member 65' is disposed so as be able to deform, locally, parallel to the walls of the reservoir and of the body but transversely to the direction of translation of the reservoir in that body. In other words, the deformation of that elastic member may be chosen independently of the thickness of the gap that exists between those walls, which makes it possible to freely choose the stiffness of that spring, its shape, its nature, etc.

It may be noted, in FIG. 2, that the retaining device constituted by those complementary retaining members is situated between the lateral walls of the reservoir and of the body; this makes it possible, in resting position, for the reservoir to be very close to the bottom of the body, giving rise to an optimum utilization of the volume thereof.

It has been stated that part of this device is mounted on the mounted-on cage-forming part 10B'. One advantage of the body comprising such a mounted-on part is that putting that device in place between the mounted-on part and the reservoir may be done outside the tube 10A and that the engagement in body of the assembly 10B+20, then ensures that these members are kept in place in configuration for cooperation.

To that end, the mounted-on part 10B' advantageously has the shape of a sleeve having (see in particular FIG. 2) a longitudinal slot 14' facing the inside zone of that sleeve where the hollow guide track is formed; that sleeve 10B' is thus of C-shaped section. Thus, when the bend 63'B of the arm 63'A has been positioned in an appropriate accommodation at the bottom of the reservoir, the transverse engagement of the reservoir through the slot, by increasing the opening of the C-shape enables the follower finger to be positioned in any zone of the hollow guide track; it then suffices to engage the assembly axially in the tube to ensure the holding in pace of the arrangement so obtained.

As a variant, the longitudinal slot 14' may have an identical width to the width of the inside volume of that sleeve, which enables easy engagement of the reservoir in that sleeve.

Lateral apertures 15' may be formed in the residual wall of the sleeve 10B', situated away from the slot 14'. Such apertures enable the sleeve to be made lighter while giving access to the inside of the sleeve.

On use of the container, when the user wishes to apply mascara, she grasps the projecting part of the cap and causes it to rise until the reservoir is brought into its high working position B and remains there due to the presence of the elastic member.

It is interesting to note that the extraction of the cap out from the body causes the reservoir to rise as a consequence of the presence of complementary sealing members providing linking between the cap and the reservoir, via the shaft to which that cap is joined.

Figure 4:
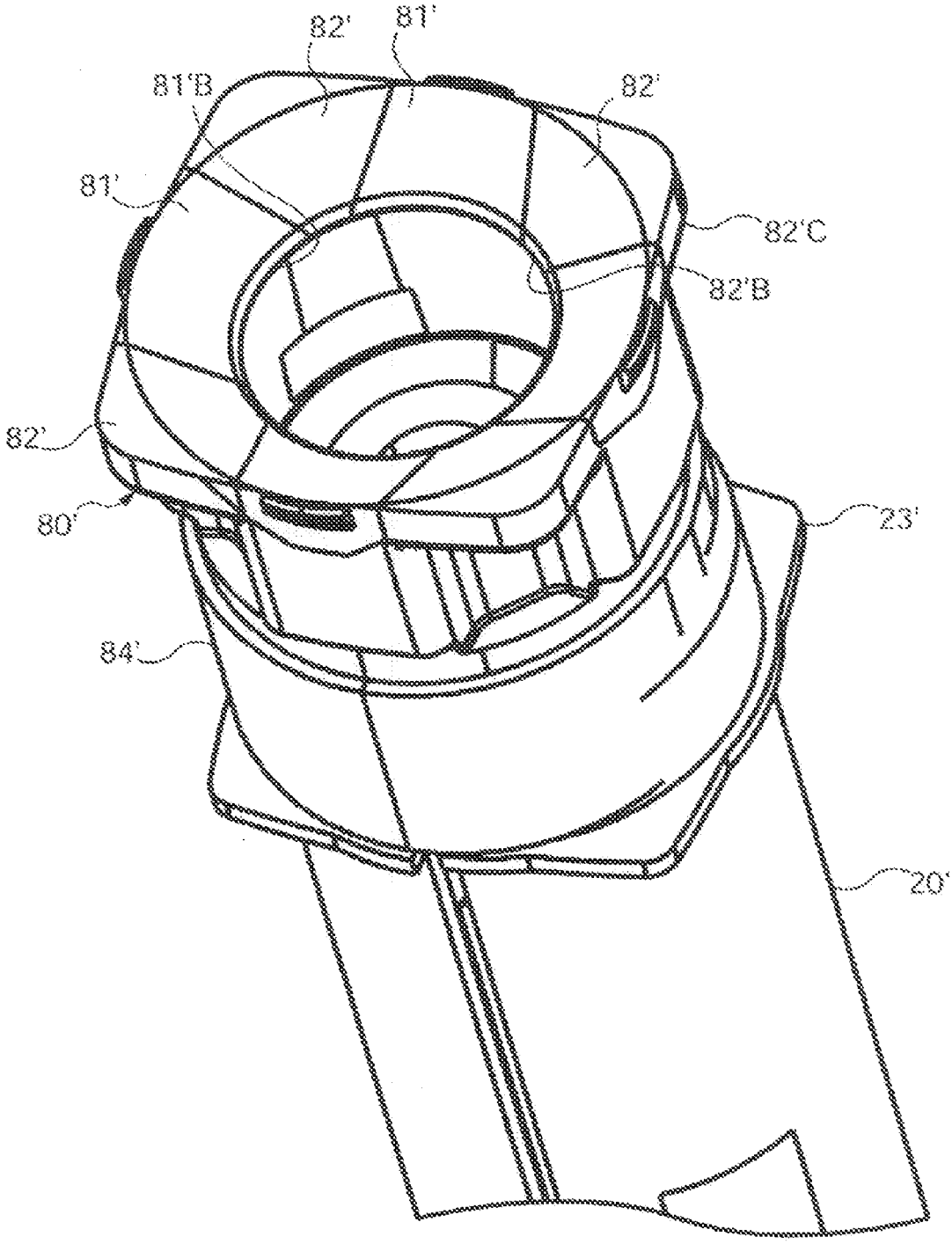
FIG. 4 is a partial view from above in perspective of the upper part of the reservoir comprised by the container of FIG. 2.
Figure 5:
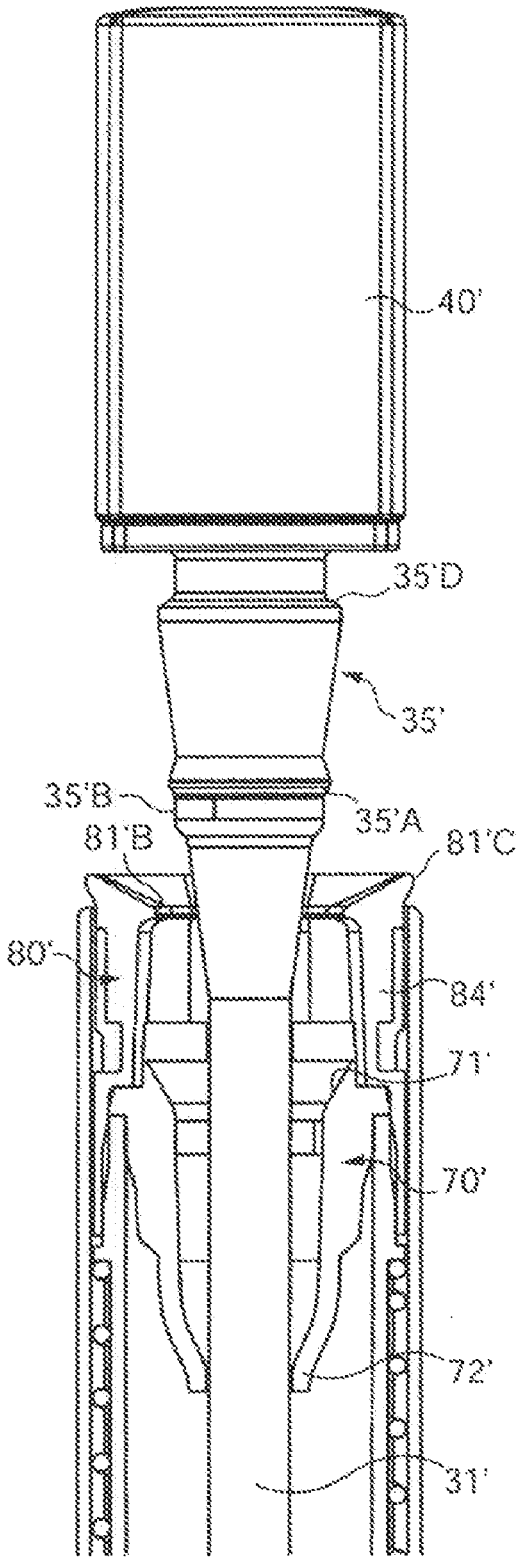
FIG. 5 is a partial view of the container, in longitudinal cross-section, showing the applicator in course of being introduced into the reservoir when the reservoir is in the high working position in the body.
Figure 6:
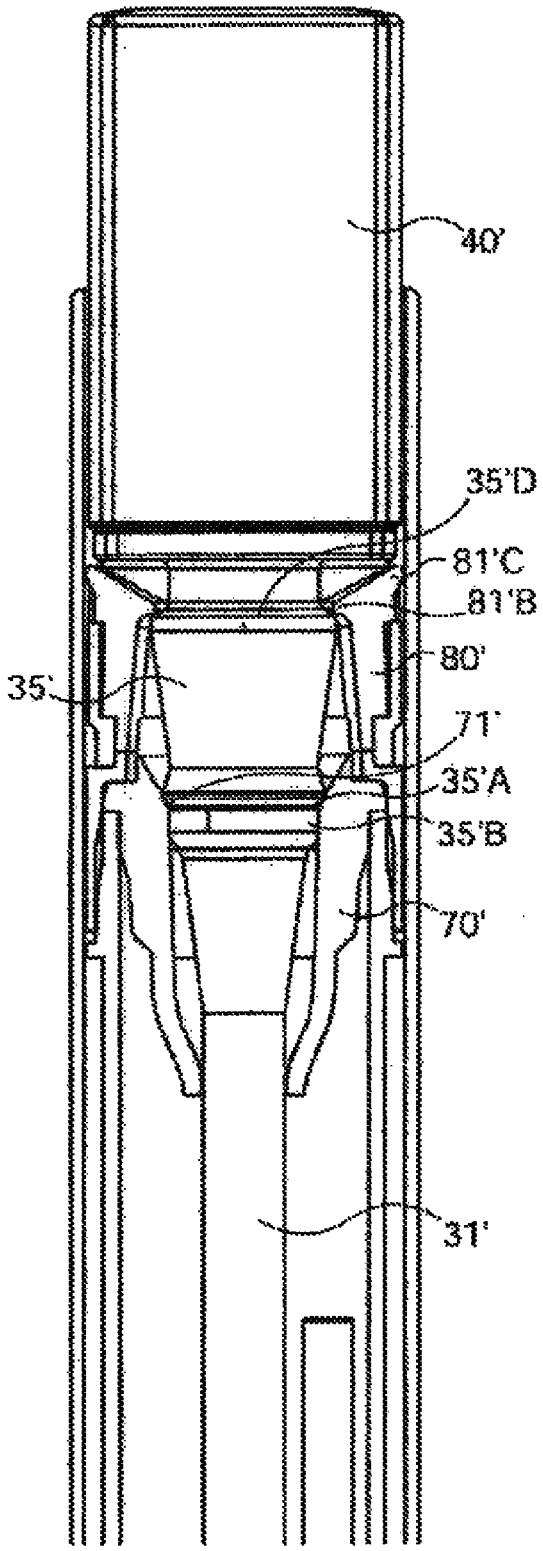
FIG. 6 is a similar view, in the resting configuration of the container.

FIG. 4 represents the part 80' assembled on the neck of the reservoir 20', whereas FIGS. 5 and 6 represent that part 80' conjointly with the wiper-forming part 70'.

In a conventional manner, that wiper forming part 70' has the purpose of controlling the quantity of product that comes out with the applicator, when the user takes the application member out of the reservoir. It is typically a part of flexible material capable of wiping the applicator in controlled manner; this part thus in practice has a form defined by the form of the applicator. This wiper-forming part comprises a constriction 71' forming a sealing contact surface, constituting a seat, adapted to cooperate with the lower part of the protuberance 35' which the application member comprises; under that constriction a wiper lip 72' is situated of any known appropriate type. It should however be noted that, since the maneuver of the application member relative to the reservoir does not need to comprise a rotating component, the form of the application member, and thus of the wiper, may be chosen freely, without necessarily being symmetrical relative to a longitudinal axis.

More particularly, the protuberance 35' comprises a sealing portion 35'A, advantageously provided with a seal, adapted to be applied axially against the sealing contact surface 71'. Advantageously, the sealing contact surface is completed by a portion forming a plug 35'C adapted to engage in the wiper-forming part 70, beyond the constriction; a complementary sealing effect results therefrom.

The protuberance 35' here has a frusto-conical general shape flaring out towards the cap and comprising, spaced away from the sealing portion 35'A towards the cap, a transverse contact surface 35'D.

The complementary sealing part 80' comprises a collar which is formed, along its circumference, with a plurality of rigid sectors 81' and flexible sectors 82', by virtue of which it has a relaxed configuration in which it is of larger transverse size than the inside cross-section of the body and a restricted configuration in which, by compression of the flexible sectors, it is confined within the internal volume of the body. In the example represented, there are rigid sectors alternating with flexible sectors.

At least the rigid sectors 81' comprise, along the inside edge of the collar, rims 81'B adapted to come into engagement axially against the transverse contact surface of the protuberance 35'. Advantageously, rims 82'B are also provided on the flexible sectors. Furthermore, those sectors advantageously comprise outside rims 81'C, or even 82'C, cooperating with the free edge of the body to force the passage of the collar from its relaxed configuration to its restricted configuration when the reservoir descends into the body.

In fact, the part 80' comprises a skirt 84' of which the axial dimension enables the axial distance between the rims 81'B and the constriction 71' to be set such that the coming into engagement of the rims 81'B against the transverse contact surface of the protuberance 35' is obtained when the sealing portion 35'A is applied against the sealing contact surface 71'; the coming into engagement of the rims against that transverse contact surface thus provides the holding in position of these sealing members.

Advantageously, the skirt 84' is rigid and forms only a single piece with the rigid sectors, whereas the flexible sectors are formed by molding onto that single piece.

It can be understood that the cooperation between edges 81'B and contact surface 35'D provides axial linkage between the reservoir and the application member so long as the collar (and the skirt) are maintained in their restricted configurations, which enables an extraction movement applied by a user on the cap, and thus on the application member, to be transferred to the reservoir, which ensures that the follower finger is indeed brought into its position B.

FIG. 5 represents a configuration in which a user has partially engaged the application member in the reservoir, that is to say that the shaft 31' has already passed through the parts 70' and 80', and the protuberance is on the point of engaging within the part 80'. The collar is in its relaxed configuration.

On passing through parts 70' and 80', the applicator 32 does not draw along the reservoir 20; this is because the reservoir 20 is retained relative to the body 10 by the member 65' which presents greater resistance than that generated by the parts 70' and 80'.

Continuation of the pushing in movement brings the sealing portion of the protuberance against the sealing contact surface 71' while the skirt of part 80' engages within the body, the effect of which is to commence the confinement effect of the collar; the inside rims 81'B are axially at the level of the rear transverse contact surface of the protuberance. The skirt provides a ramp effect, amplified by the presence of the outside rims 81'C, and even 82'C, to cause, together with the free edge of the body, the deformation of the collar until the restricted configuration is attained. The entry of the collar into the body causes the movement towards each other of the rims 81'B and thus the coming into engagement thereof against the transverse contact surface 35D: the collar is thus in its restricted configuration.

This movement continues until the reservoir reaches its maximum pushing-in configuration, corresponding here to a partial retraction of the cap in the body, over approximately half its height (FIG. 6). As a variant not represented, that portion of the cap which still projects may be greater or on the contrary smaller, depending on requirements as well as on the state of the surface of that cap.

Figure 7:
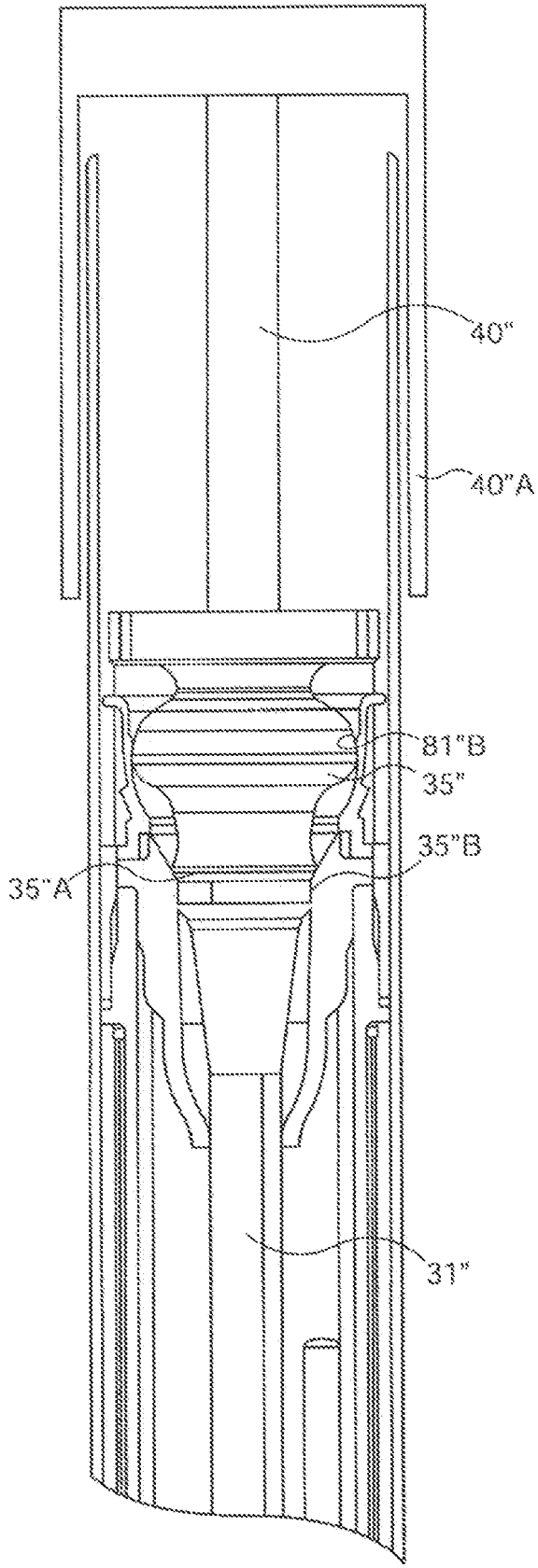
FIG. 7 is a similar view to that of FIGS. 5 and 6, representing the upper part of another container in resting configuration.

FIG. 7 represents another embodiment of container in accordance with the invention, which, relative to that which has just been described, has two differences which are in practice independent of each other.

The members of this other container which are similar to those of the one of FIGS. 2 to 6, are designated by reference signs which may be deduced from the ones used in those FIGS. 2 to 6 by replacement of the single quote index by the double quote index.

One of the differences lies in the way in which the sealing, and thus the linking, is produced.

It can thus be observed that, in the example of FIG. 7, the collar has been replaced by bosses 81"B formed on the inside wall of the reservoir above the seat-forming portion for the sealing contact surface 35"A. Furthermore, the protuberance here no longer has a frusto-conical shape but more rounded, the bosses cooperating on the portion of that protuberance which has the maximum cross-section.

In fact, the implementation of such bosses, provided they are of sufficient size, has appeared to enable sufficient sealing and linking to be provided for a mascara container, especially when the protuberance comprises the plug-forming portion 35"B.

Another difference lies in the fact that, in the example of FIG. 7, the cap 40" comprises an outside skirt 40"A which passes externally along the body at the time of its telescopic engagement in the body.

FIGS. 8 to 16 represent another retaining device example capable of delimiting the high position of the reservoir in the body. The members similar to those of the preceding Figures are designated by numbers which may be deduced from those used in those preceding Figures by the addition of the number 100 and the deletion of the indices.

Figure 8:
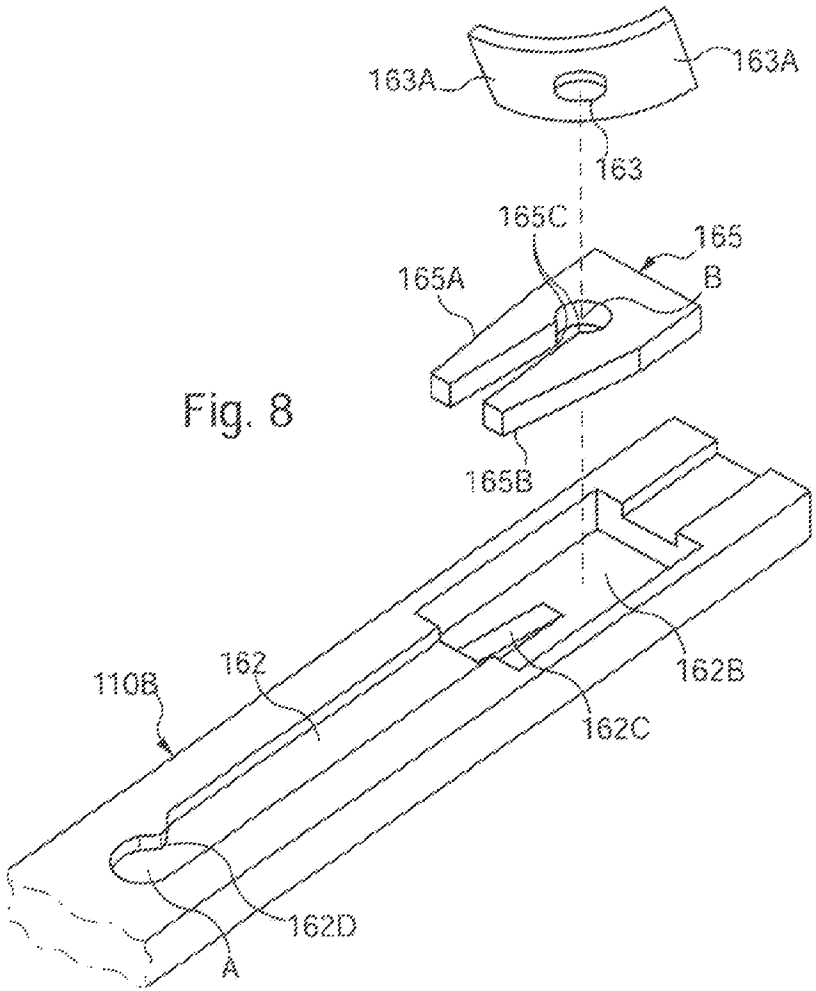
FIG. 8 is an exploded view of other complementary retaining members adapted to maintain the reservoir in its high position, according to another embodiment.

FIG. 8 thus represents a part 110B adapted to be inserted longitudinally in the body, in similar manner to the part 10B' of FIGS. 2 and 3. This part is elongate and is adapted to be joined to that body by any appropriate means, for example by bonding.

This elongate part 110B comprises a longitudinal guide track 162, adapted to cooperate with a follower finger formed by a lug 163 adapted to be longitudinally linked to the outside wall of the reservoir. This lug here forms an integral part of an elastic convex part, advantageously of metal, provided with elastic arms 163A; as a matter of fact, this lug is adapted to be elastically urged towards the part 110B. This track comprises a blind end A, and located away from that blind end, a cavity 162B adapted to receive a U-shaped part 165, forming a retaining clip, having its concavity turned towards the blind end. Between the branches 165A and 165B of that U-shaped part, the cavity comprises a longitudinal ramp 162C going from the level of the bottom of the cavity to reach the bottom of the track. In their resting configuration, the flanks of the arms of the U-shaped part extend onwards from the track. This U-shaped part is formed, in the vicinity of the junction of the arms with the base of the U, so as to define conjointly with the bottom of the cavity, an accommodation B adapted to receive the lug 163.

The U-shaped part has, at the exit of that accommodation, a stricture 165C conjointly formed by widening of each arm. This stricture has a width less than the width of the lug 163.

Beyond this stricture, the arms have facing edge surfaces which progressively diverge from each other, on respective opposite sides of the ramp, while having a separation that is still less than the width of the lug.

Advantageously, the track 162 comprises a projection 162D in the vicinity of the blind end A, which projection is lateral here (more particularly there is a pair of two projections), defining a local stricture of the track.

The retaining clip is advantageously joined to the part 110B, for example by means of a transverse pin, or by partial bonding, leaving the arms free to spread into the cavity.

Figure 11:
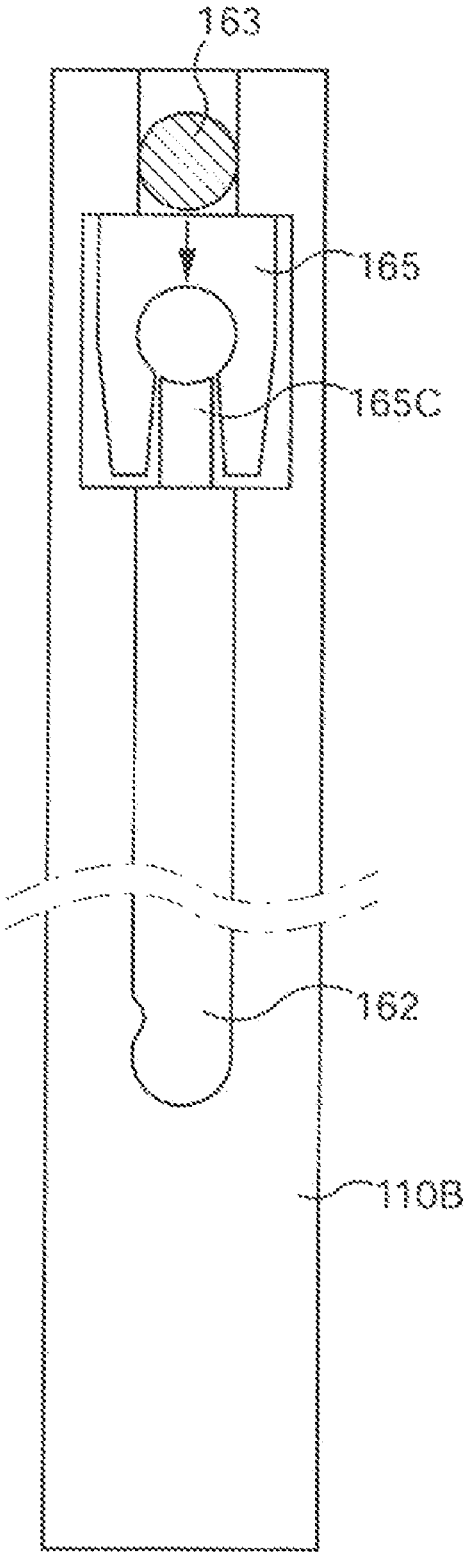
FIG. 11 is an elevation view of the complementary members of FIG. 8, in phase of introduction of the reservoir into the body.
Figure 12:
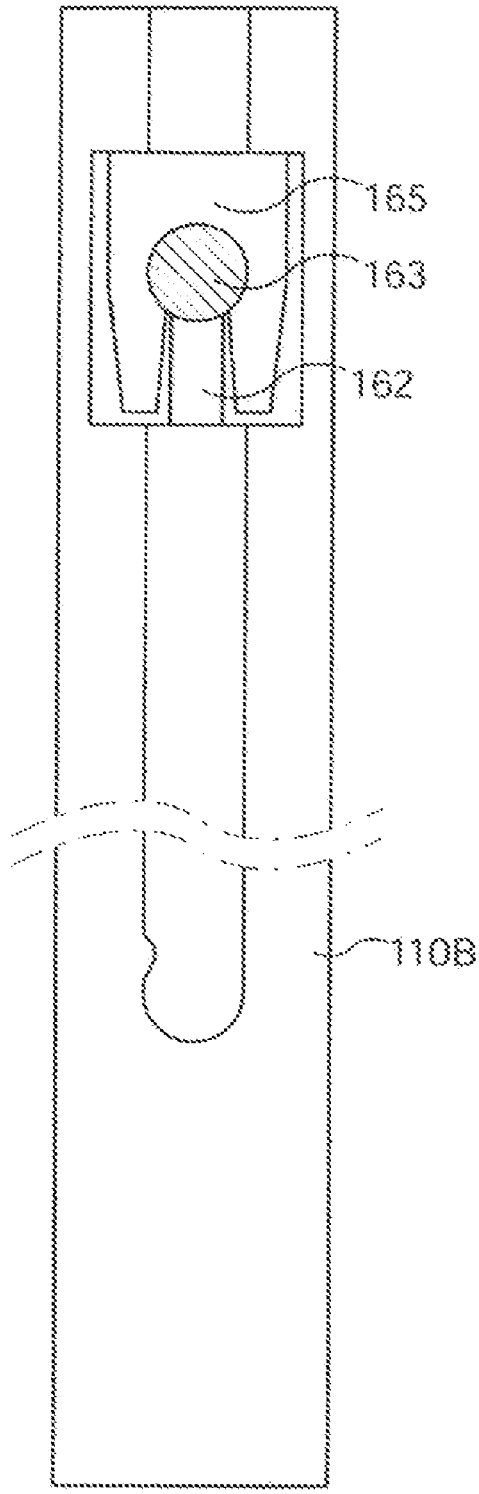
FIG. 12 is a similar view, in a configuration corresponding to the high position of the reservoir in the body.

The engagement of the reservoir in the body is easily made, after linking of the lug 163 with that reservoir, by sliding the latter in the part of the track situated beyond the cavity 162B (see FIG. 11).

Figure 13:
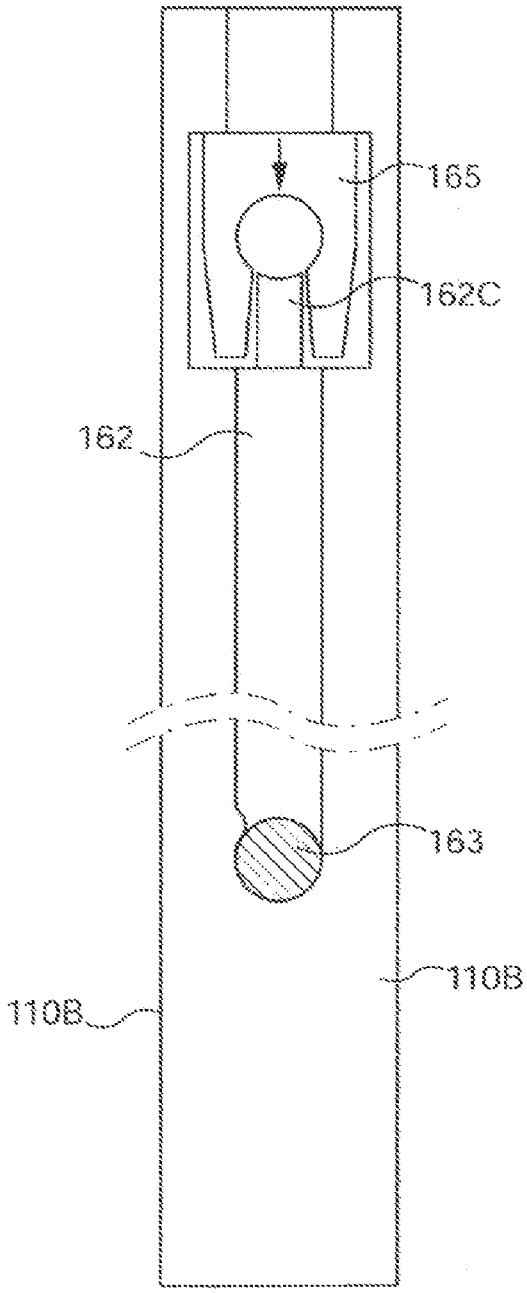
FIG. 13 is a similar view, in a configuration corresponding to the low position of the reservoir in the body.

The high position of the reservoir is defined by the cooperation of the members 110B and 163 in a configuration in which the lug 163 is in the accommodation B (FIG. 12), while the low position is defined by those same members in a configuration in which the lug 163 is in the blind end A (FIG. 13).

Figure 10:
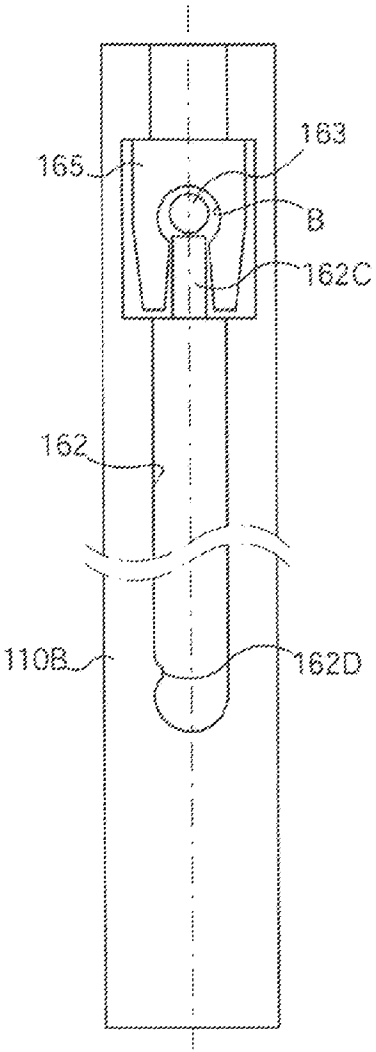
FIG. 10 is a front view.
Figure 9:
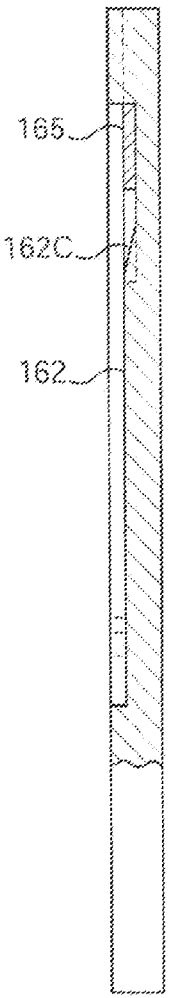
FIG. 9 is a side view, in partial cross-section, of a part of the complementary means which are adapted to be carried by the body of a container according to that second embodiment.
Figure 14:
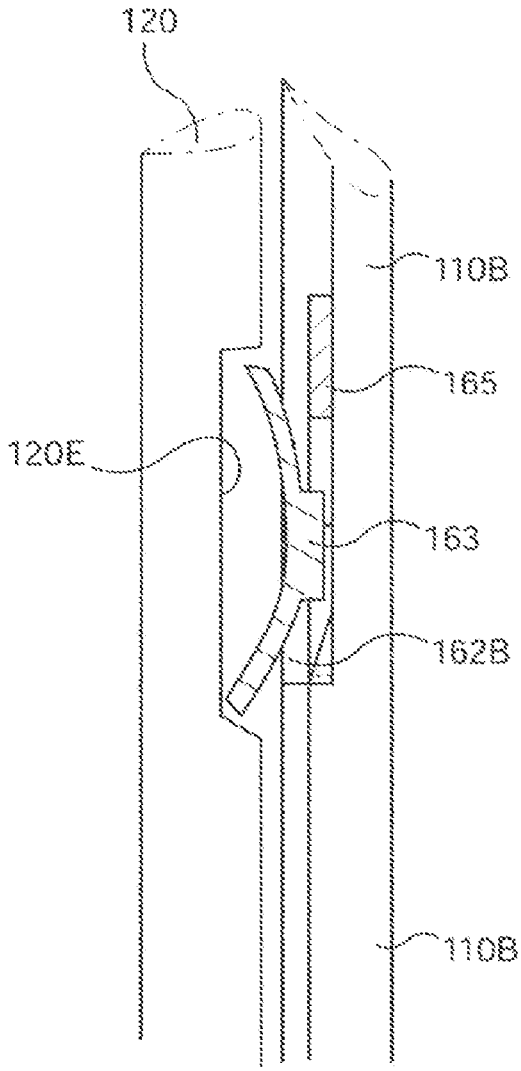
FIG. 14 is a cross-section view of the members of FIG. 8 in their configuration defining the high position.
Figure 16:
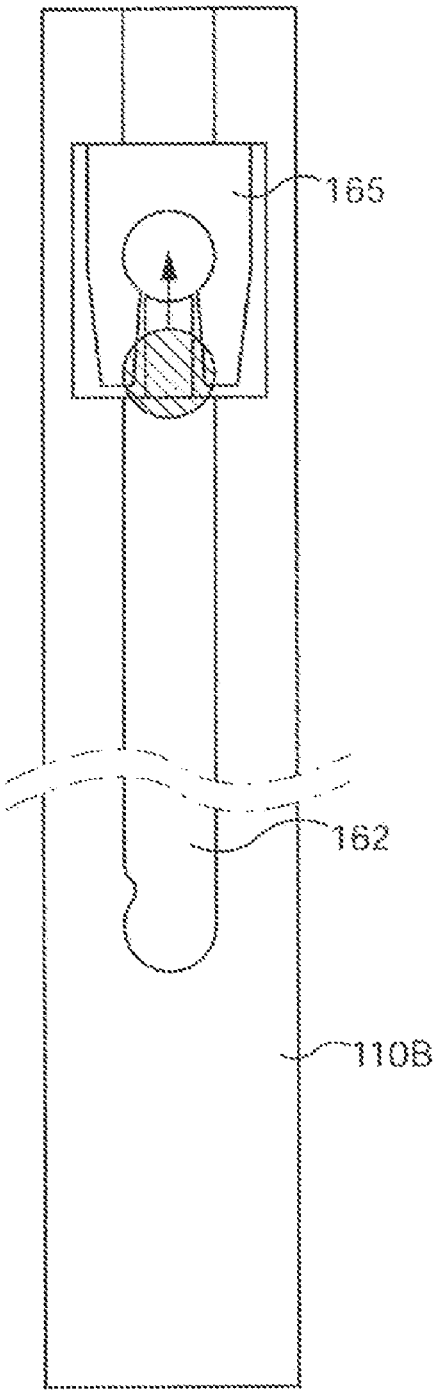
FIG. 16 is a similar view to that of FIG. 15, but in a configuration corresponding to the end of a rising movement of the reservoir in the body.

FIG. 14 is a section view showing the cooperation of the various members represented in FIGS. 8 to 10. It can thus be noted that the lug 163 is engaged in a cavity 120E of small dimensions of the outside wall of the reservoir 120, pushed by its arms towards the bottom of the cavity 162B. The longitudinal dimension of the cavity 120E is just sufficient for the arms of the elastic support of the lug to be able to come to be accommodated between its edges while being able to deform so as to enable the lug to retract at least in part within that cavity 120E when the lug is in register with the track.

In this second embodiment, the reservoir and the application member comprise complementary sealing and linking members similar to those of FIGS. 2 to 7, capable of providing, when they cooperate, linkage of that reservoir and of that application member.

When the reservoir is in its high position in the body, the lug is engaged in the accommodation B, between the arms of the retaining clip 165. The lug is maintained in that position by the fact that the stricture 165C formed on the arms does not enable that lug to come out without the arms moving apart by elastic deformation, by bending of those arms. A significant force must therefore be applied to force the arms to move apart (see FIG. 15). When the arms have moved apart sufficiently, the lug slides by its front part on the ramp, which forces the arms 163A to deform to enable retraction of the lug into the cavity 120E, which also contributes to resisting any inadvertent descending movement of the reservoir into the body. While the lug retracts into the cavity of the reservoir by leaving that of part 10B", it frees itself from the arms of the retaining clip and its end arrives at the location of the end of the track; the lug may then follow the track 162 towards the lower point, until it passes the stricture 162D (if it exists) and attains the low position defined by the zone A of FIG. 13.

When a user desires to apply product, she pulls on the cap, and thus on the application member, and thus on the reservoir to which that member is linked. A force results tending to make the lug rise along the track. The force applied must overcome the point of resistance constituted by the stricture formed by the projections 162D.

When the lug attains the cavity 162B, the consequence of the fact that, in their resting configuration, the flanks of the arms of the retaining clip continue onwards from the track is that the lug slides on those flanks without coming between those arms (FIG. 16); it follows that the retaining clip causes no resistance to the passage of that lug until it latches into the accommodation B. The reservoir is thus in its high position, as in FIG. 12.

FIGS. 17 and 18 represent a variant embodiment of the complementary retaining members of the aforementioned container. In these Figures, the members that are similar to those of FIGS. 8 to 16 are designated by signs which can be deduced from those used on those Figures by the addition of the number 100.

Thus FIG. 17 represents a part 210B, corresponding to the sleeve 10B' of FIG. 3, on the inside wall of which the longitudinal track 262 is formed with a lower end portion similar to that of FIG. 3, and an upper end portion similar to that of FIGS. 10 to 16.

The cavity 262B in which the U-shaped part 265 is engaged is formed here within the thickness of the wall of that part 210B and no longer transversely to that thickness starting from the inside surface; this facilitates the putting into place of that part 265, while avoiding that part being able to escape out from the cavity when movements of the follower finger take place.

This follower finger 263 is analogous to the follower finger of FIGS. 2 to 7, being carried by an arm 263A connected to a portion 263B for articulation to the bottom of the reservoir.

Figure 15:
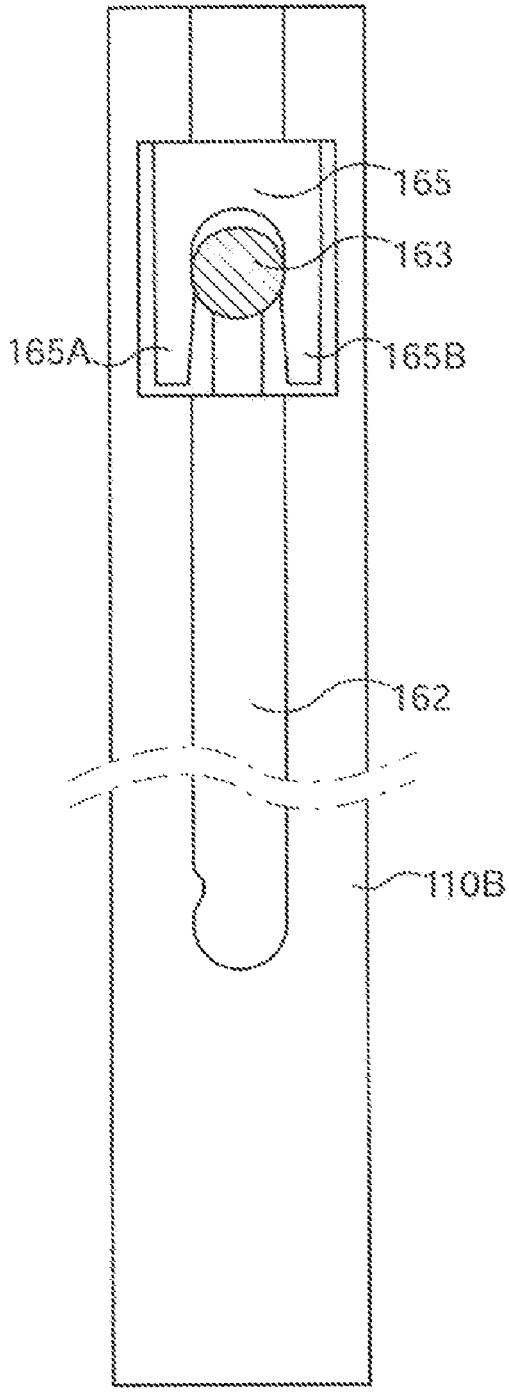
FIG. 15 is a similar view to that of FIG. 12, in a configuration in which the reservoir has started to be pushed into the body.

The cooperation between that part 265 and that follower finger 263 is represented in FIG. 18; it is analogous to that described with regard to FIGS. 8 to 16, the arm 263A having sufficient elastic flexibility to urge the finger towards the bottom of the cavity, while permitting retraction thereof when the follower finger has come out of the cavity, by moving apart the branches of the part 265, as in FIG. 15.

FIG. 19 is a variant of FIG. 17 in which the similar members are designated by reference signs which are deduced from those of that Figure by the addition of the number 100.

This variant is distinguished from the embodiment of FIG. 17 by the fact that the U-shaped part 365 comprises a bridge between its branches so as to completely close the outline of the space in which the follower finger comes to latch in the high position of the reservoir, in this way, the U-shaped part is no longer an elastic part, in the sense indicated above, since the branches of that part can no longer move apart.

The escape of the follower finger out from the hollow formed in that mounted-on part 365 may then be provided by the inclination of the follower finger parallel to the track as represented in FIG. 20, for example by bending of a connection zone of that finger to the arm 363A which carries it.

As a variant, this follower finger 363 may be replaced by a lug 463, carried by a convex elastic strip having elastic arms 465 as in FIG. 8, but presenting an inclined flank 464 adapted to enable, by a ramp effect which is all the more marked that this flank is strongly inclined towards the longitudinal axis of the container, the escape of the follower finger out from the hollow of the part 365 when a sufficient force is applied to the cap to make it descend along the body;

It can be understood that, in the examples of FIGS. 19 to 21, the ramp provided in the cavity containing the mounted-on part may be omitted; however, when it is present, it may have the advantage of facilitating the good guidance of the end of the follower finger to attain the bottom of the track outside the cavity.

It may be understood that, in FIGS. 18 and 20, the representation of the follower finger in dashed line corresponds to a configuration in which the follower finger is in course of passing along the hollow track.

The invention claimed is:

1. A container for a pasty or liquid cosmetic product, comprising:

an elongate body extending in a longitudinal direction, and comprising a bottom zone and a free edge;

a reservoir comprising said product and a neck, wherein said reservoir is movable in translation in the body between a low resting position close to the bottom zone and a high working position close to the free edge;

an application member comprising a shaft joined to a cap and terminated by an applicator, wherein:

said application member is adapted to be loaded with said product when the shaft of the application member is inserted through the neck into the reservoir in a reloading configuration, the cap is adapted to engage in or on the body by pushing the shaft into the reservoir to the low resting configuration, and the cap is adapted be extracted from the body and to enable extraction of the shaft and the applicator out of the reservoir and from the body, and complementary sealing members respectively located on the shaft of the application member and on the reservoir near the neck, wherein said complementary sealing members are adapted to link the shaft and the reservoir in a substantially sealed configuration during translation from the low resting position to near the high working position of the reservoir in the body, wherein the high position of the reservoir in the body is defined by complementary retaining members located between the body and that reservoir and adapted to generate a resistance to the descent of the reservoir into the body from said high working position, and further wherein the cap is adapted to provide a sufficient grip to enable a user to extract the application member from the body when the cap is linked to the reservoir and the reservoir is in the low resting position.

2. The container of claim 1, wherein the complementary retaining members are adapted not to hinder movement of the reservoir into the high working position at the end of the reservoir's rise from the low resting position.

3. The container of claim 1, wherein the complementary retaining members comprise:

a hollow guide track substantially disposed in the longitudinal direction of the body, a follower finger adapted to pass in the hollow guide track during movement of the reservoir between the low resting position and the high working position in the body, and an elastic member located near the hollow guide track wherein said elastic member elastically resists the passage of the follower finger as the reservoir begins to move from the high working position to the low resting position.

4. The container of claim 3, wherein said elastic member is adapted to deform parallel to the walls of the reservoir and of the body and transversely to the longitudinal direction of the body.

5. The container of claim 4, wherein:

the elastic member is disposed along a side of an end of the hollow guide track that defines, together with the follower finger, the high working position of the reservoir; and the elastic member is adapted to encroach on a path of the follower linger such that the follower finger elastically must bend the elastic member upon passing.

6. The container of claim 5, wherein:

the end of the guide track defining, with the follower finger, the high working position of the reservoir comprises a drop-shaped portion the bottom of which comprises non-return steps that cause the follower finger to pass in a single direction, and the elastic member is located such that the follower finger passes it at the start of movement of the reservoir from the high working position to the low resting position.

7. The container of claim 3, wherein:

the hollow guide track comprises a cavity in the bottom of an end of said hollow guide track that defines, together with the follower finger, the high working position of the reservoir, said cavity comprises a ramp that is parallel to the longitudinal direction of the body, and said ramp is connected to the bottom of a remainder of the guide track, the follower finger is adapted to be elastically urged towards the bottom of the track, the elastic member comprises a U-shaped part comprising branches, the elastic member is located in the cavity such that said branches are longitudinally oriented, the branches are configured to form a space between them adapted to receive the follower finger, the branches comprise a stricture at an end opposite to a bottom of the U-shaped part, the stricture is formed such that the follower finger can only pass outward from the space and the U-shaped part by forcing the branches to move apart, and the branches are adapted such that, when the reservoir approaches the high working position, the follower finger slides on the bottom of the guide track, then over the branches, and then latches into the space.

8. The container of claim 3, wherein:

the hollow guide track comprises a cavity in a bottom of an end of the guide track that defines, together with the follower finger, the high working position of the reservoir, the follower finger is elastically urged towards the bottom of the guide track or a bottom of the cavity, the elastic member comprises a mounted-on part, the elastic member is located in the cavity and is adapted to allow the follower finger to slide over the elastic member and latch in the cavity when the reservoir approaches the high working position, and the cavity comprises a ramp that is adapted to allow the follower finger to exit the cavity.

9. The container of claim 8, wherein the follower finger is connected to an elastically flexible strip, and the guide track comprises a flank comprising a ramp that is adapted to enable the follower finger to exit the cavity.

10. The container of claim 8, wherein the follower finger is connected to a support by a flexible connection zone, such that the follower finger capable of inclining longitudinally to exit the cavity.

11. The container of claim 1, wherein the hollow guide track comprises, at an end that defines, together with the follower finger, the low resting position of the reservoir, a cul-de-sac portion comprising a stricture adapted to resist passage of the follower finger.

12. The container of claim 1, wherein:

the application member comprises a protuberance on the shaft, the protuberance comprises a sealing portion towards the applicator and a transverse contact surface towards the cap, the reservoir comprises a constriction near the neck of the reservoir that is adapted to receive the sealing portion in axial abutment, the reservoir comprises a collar comprising a plurality of alternating rigid sectors and elastic sectors along its circumference, the collar comprises a relaxed configuration wherein the collar is larger than the inside cross-section of the body, the collar comprises a restricted configuration wherein the collar is confined inside the body, the rigid sectors comprise rims along the inside edge of the collar that are adapted to axially abut against the transverse contact surface to maintain the sealing portion against the constriction when the application member is in a resting configuration.

13. The container of claim 1, wherein the complementary sealing members comprise:

a protuberance on the shaft of the application member, comprising a sealing portion towards the applicator, and a transverse contact surface towards the cap, and a seat-forming constriction on the reservoir adapted to receive the sealing portion in axial abutment, and at least one boss located on the inside wall of the reservoir between the neck and the seat-forming constriction wherein:

the at least one boss is adapted to pass by the protuberance when the application member is engaged in the reloading configuration in the reservoir, and the at least one boss is adapted to maintain the protuberance against the seat-forming constriction when the application member remains in the reloading configuration.

14. The container of claim 1, wherein the complementary sealing members comprise means for sealing the applicator member to the reservoir.

* * * * *